US007955195B2

(12) United States Patent
Payer

(10) Patent No.: US 7,955,195 B2
(45) Date of Patent: Jun. 7, 2011

(54) CROQUET MODIFYING GAME

(76) Inventor: Christopher M. Payer, Greenfield, NY (US)

( * ) Notice: Subject to any disclaimer, the term of this patent is extended or adjusted under 35 U.S.C. 154(b) by 0 days.

(21) Appl. No.: 12/726,394

(22) Filed: Mar. 18, 2010

(65) Prior Publication Data

US 2010/0184535 A1 Jul. 22, 2010

Related U.S. Application Data

(62) Division of application No. 11/866,608, filed on Oct. 3, 2007, now abandoned.

(51) Int. Cl.
*A63B 67/00* (2006.01)

(52) U.S. Cl. ..... 473/410

(58) Field of Classification Search ..... 473/410–413, 473/157–166, 170, 181, 185
See application file for complete search history.

(56) References Cited

U.S. PATENT DOCUMENTS

| | | | |
|---|---|---|---|
| 95,969 | A | 10/1869 | Barlow |
| 1,078,330 | A | 11/1913 | Beavens |
| 1,184,196 | A | 5/1916 | Michell |
| 1,246,297 | A | 11/1917 | Michell |
| 1,469,301 | A | 10/1923 | Hanke et al. |
| 1,557,284 | A | 9/1924 | Horowitz |
| 2,019,302 | A | 10/1935 | Gibson |
| 3,425,696 | A | 2/1969 | Dockum |
| 3,610,631 | A | 10/1971 | Mulherin |
| 4,093,233 | A | 6/1978 | Barbarow |
| 4,132,411 | A | 1/1979 | Breslow et al. |
| 4,743,026 | A | 5/1988 | Eady |
| 4,868,564 | A | 9/1989 | Falconer |
| 5,156,409 | A | 10/1992 | Barnes |
| 5,201,519 | A | 4/1993 | Sorteberg |
| 5,316,302 | A | 5/1994 | Sedberry |
| 5,390,935 | A | 2/1995 | Wilkins |
| 5,692,979 | A | 12/1997 | Jones |
| 5,860,648 | A | 1/1999 | Petermeier et al. |
| 6,123,334 | A | 9/2000 | Norris |
| 6,273,425 | B1 | 8/2001 | Westfall et al. |
| 6,474,648 | B1 | 11/2002 | Rogers |
| 6,715,762 | B2 | 4/2004 | Simmons |
| 7,121,963 | B2 | 10/2006 | Corbin et al. |
| 7,357,737 | B1 | 4/2008 | Cutler |
| 2005/0258599 | A1 | 11/2005 | Mumaw |
| 2006/0270497 | A1 | 11/2006 | Dehen |

OTHER PUBLICATIONS

Rules of 9 Wicket Croquet, (Rules), United States Croquet Association, 2006, pp. 1-12.
Final Office Action (Mail Date Oct. 26, 2009) for U.S. Appl. No. 11/866,608, filed Oct. 3, 2007.

*Primary Examiner* — Mark S Graham
(74) *Attorney, Agent, or Firm* — Schmeiser, Olsen & Watts, LLP

(57) ABSTRACT

A croquet modifying game includes at least one indicator such as a playing card. The playing card includes player instructions, wherein the player instructions modify standard play of a game of croquet. A corresponding method of playing croquet is provided.

12 Claims, 7 Drawing Sheets

CROQUET MODIFYING GAME

This application is a divisional application claiming priority to U.S. application Ser. No. 11/866,608 filed on Oct. 3, 2007, entitled CROQUET MODIFYING GAME.

BACKGROUND OF THE INVENTION

1. Technical Field

The present invention generally relates to games. More particularly, the present invention relates to a game to be played in conjunction with a game of croquet, wherein an indicator such as a card play modifies standard croquet play.

2. Related Art

Croquet is an old and well-known game which involves hitting round balls with a mallet through wickets positioned in a playing area. The game is played by many people throughout the world and is well-liked because game play is interesting and the rules are relatively simple. A known card game was even developed to regulate play of a standard nine-wicket croquet game by means of labeled cards (see U.S. Pat. No. 1,078,330). Because standard croquet is so simple, the game can become too predictable leaving players and spectators disinterested in game play. To add more excitement to the game, some players have modified game play by making the play area "extreme"; adding obstacles such as sand traps, streams, or miniature golf-like obstacles. However, even the incorporation of "extreme" obstacles and ad hoc rule modifications have left many people still desiring greater excitement in game play. Accordingly, a need exists for providing an exciting croquet modifying card game.

SUMMARY OF THE INVENTION

The present invention provides an indicator such as a card game, which, when played in conjunction with a game of croquet, modifies the play of the croquet game.

A first aspect of the invention provides a croquet modifying game comprising: at least one indicator, the indicator including player instructions, wherein the player instructions modify standard play of a game of croquet.

A second aspect of the invention provides a card game to be played in conjunction with a game of croquet to modify play of the croquet game, the card game comprising: a first deck of playing cards, wherein each of the cards in the first deck includes directives altering traditional play of a croquet game.

A third aspect of the invention provides a method of playing croquet comprising: providing a standard croquet setup; providing at least one playing card, the playing card including player instructions, wherein the player instructions modify standard play of a game of croquet involving at least two participants; beginning standard play of the croquet game; and modifying standard play of the croquet game through application of the instructions on the at least one playing card.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
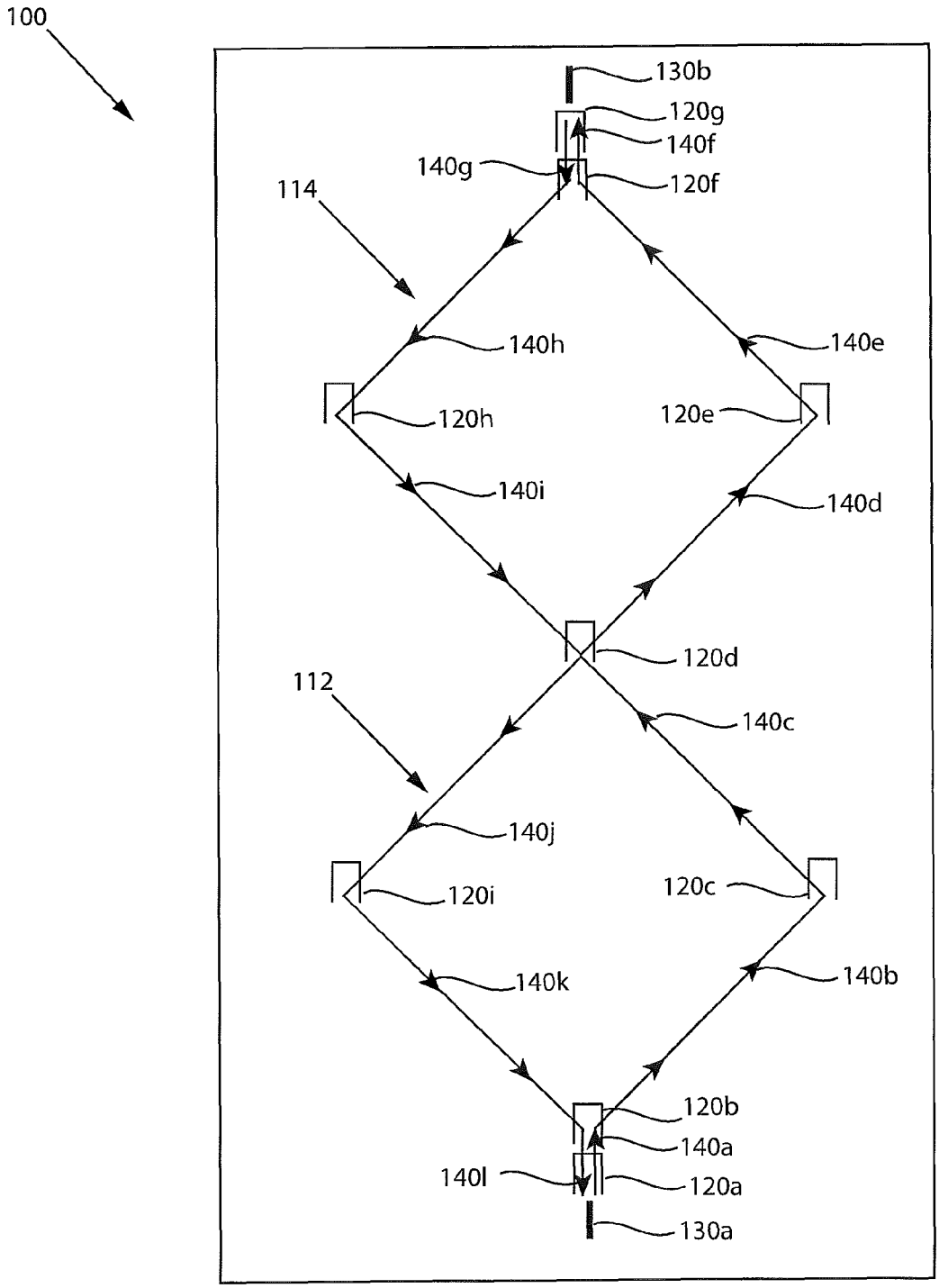
FIG. 1 depicts a top view of a standard nine wicket setup, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply for exemplary purposes in depicting a possible embodiment or embodiments of the present invention. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

There are two standard setups for croquet: a nine wicket setup and a six wicket setup. With reference to the drawings, FIG. 1 depicts a standard nine wicket setup 100; the nine wicket setup is commonly called the double diamond pattern due to the diamond shaped positioning 112, 114 of the wickets 120 and the corresponding direction of play. Traditionally, players pick out a field upon which to play and position the nine wickets and two stakes in a pattern similar to that depicted in FIG. 1. The wickets may be formed in the shape of hoop-like semi-circles, horseshoe-like arches, half-rectangle frames, polygonal shaped structures, or otherwise formed to have a center opening defined by two legs being insertable into the playing field. Ideally the field will be 100 feet by 50 feet on relatively even ground. However, standard croquet play does not need to conform to strict dimensions and often the play area is much smaller or sometimes larger than the ideal field. Moreover, standard croquet play need not even take place on an actual field. For instance, in the croquet game discussed in U.S. Pat. No. 1,078,330 the play area is not strictly required; instead the play area is relegated to a small tally board. In addition, croquet play may take place in an online virtual environment, or through digital depiction provided by an electronic game system, such as the Nintendo Wii®. Almost any conceivable play area environment may be used (within reason) to position wickets in a manner similar to the setup 100 shown in FIG. 1. The game was designed to be played with four or six balls. Yet it may be played with any number of players, typically ranging between two to twelve players.

Standard nine wicket croquet can be played in teams or individually. If played by teams, generally two squads are formed. However, it is conceivable to have more than two teams. For example, a game played with six balls may involve three teams of two players each. If there is an odd number of players then the extra player(s) may play multiple balls. Croquet may also be played "cut-throat" wherein each player plays one ball and scores for himself or herself. The order of play (how players know whose turn it is to hit their respective ball) is typically determined by color and where that color appears on the stakes 130, which are usually ringed with color bands corresponding to ball colors. Players may choose to play a certain color ball or may be assigned to play a ball of a particular color based on a decision by a team captain, or by spinning a color wheel to see what corresponding color the needle stops on. A coin toss can also help determine which player or team will go first. Generally, the player with the colored ball that corresponds to the color band at the top of each stake 130 goes first. Then players take their turns in correspondence with the order of various color rings that are positioned on the stakes 130. When all the players have taken a turn, the first player then takes a second turn and the order repeats until the game ends, or players are eliminated. Preferably players on opposing teams take alternating positions in play, but it is not necessary.

During game play, points may be scored as players advance their balls through the wickets 120. Ordinarily one point is awarded for every wicket passed through in the proper direction and during the proper turn. Points are also awarded each time a stake 130 is hit. To win at croquet, a player or team must score the highest number of points. A winning score is normally equated with the first player or team to reach 16 points.

Standard croquet play generally begins when a player with the first turn places his or her ball about mid-way between the head stake 130*a* and the first wicket 120*a* and strikes the ball with the mallet in an attempt to pass through the first 120*a* and second wickets 120*b*. A player receives a bonus stroke for every wicket the player's ball correctly passes through. For instance, if during the first play of the game the first player's ball passes through both the first 120*a* and second 120*b* wickets, then the first player receives two bonus strokes. Ordinarily, bonus strokes may also be obtained by hitting another player's ball or by hitting a stake. Bonus strokes typically do not accumulate as the player advances through multiple wickets. Rather the stroke count is generally reset to one stroke each time a player passes through a wicket. A player may only play a bonus stroke from the ball position that resulted when the bonus stroke was obtained. For example, if the first player hit a ball through both the first and second wickets 120*a,b*, then the player can only play the first of two earned bonus strokes from the end position of the ball after it passed through the wickets 120*a,b*.

As discussed, another common way to obtain bonus strokes is by hitting another player's ball; this is sometimes called roqueting. Two bonus strokes are typically awarded for hitting another player's ball. If a player roquets (or hits another player's ball) the player usually has four options. First, the player may take two bonus strokes from wherever the ball wound up after hitting the other player's ball. Second, the player's ball may be placed a single mallet head's length away from the ball that was hit, in any direction the player chooses, and then the player may take the two earned bonus strokes. Third, the player may put the player's ball next to the ball that was hit and move the previously hit ball by striking the player's own ball to move it into contact with the hit ball so that both balls collide with each other and move in various directions after the collision. Then with the one remaining bonus shot the player may strike his or her own ball to move it in a direction 140 of desired play, such as toward the next wicket 120. Lastly, a player may place his or her own ball side by side with the hit ball. Then the player may place his or her foot on the player's own ball the player can strike his or her own ball thereby transferring force onto the other ball so that the other ball moves without moving the player's own ball. This is often called "sending" another ball, or is commonly referred to as a "croquet" shot. The player then has one bonus stroke left to utilize in a manner according to the player's choosing.

Normally a ball may only be roqueted once per turn unless the player goes through a wicket 120 or hits the turning stake 130*b*. However, a player may roquet more than one ball per turn between wickets 120. If a player moves another player's ball through a wicket or causes it to hit a stake, the wicket or stake is scored (meaning a point is awarded), but no bonus strokes are awarded. If a ball is hit out of bounds, the ball can be brought back into play within the playing field by placing the ball one mallet stick's length into the playing field approximately the point where the ball went out of bounds. However, croquet games are often played with no out of bounds. Traditionally, balls may be struck only with the face of the mallet. Nevertheless, the side or other portions of a mallet can be utilized in standard croquet play if the players deem it acceptable. A mallet of one player cannot strike the ball of another player in standard croquet play.

During a standard game, a player aims to advance a ball as follows: (1) from a position between stake 130*a* and wicket 120*a* through wickets 120*a* and 120*b* by striking the ball and moving it in a direction 140*a*; (2) then the ball can be advanced in a direction 140*b* toward and ultimately through wicket 120*c*; (3) from there the ball can be maneuvered in a direction 140*c* toward and through the center wicket 120*d*; (4) and again toward 140*d* and through wicket 120*e*; (5) the ball may be played onward toward 140*e* wickets 120*f* and 120*g*; (6) the player can then seek to move the ball in a direction 140*f* through both wickets 120*f* and 120*g* to hit the turn stake 130*b*; (7) once a player has hit the turn stake 130*b* the ball can then be hit and moved in a direction 140*g* back through wickets 120*g* and 120*f*; (8) then the ball can be advanced in a direction 140*h* toward and ultimately through wicket 120*h*; (9) from there the ball can be maneuvered in a direction 140*i* back toward and back the other way through the center wicket 120*d*; (10) and then toward 140*j* and through wicket 120*i*; (11) the ball may be played onward toward 140*k* wickets 120*b* and 120*a*; (12) the player can then seek to move the ball in a direction 140*l* and ultimately back through both wickets 120*b* and 120*a*; (13) at that point, the player has various options of play.

There are a few play options commonly available when a player has made it all the way around the course and back through the wickets 120*b* and 120*a*. For instance, a player may proceed to hit the stake 130, at which point play for that player can end. Otherwise a player may purposefully avoid contact with the stake 130 and return to the field as a rover seeking to roquet and "send" opposing players. This option usually employed in cut-throat play (no teams) and team play occurs when a player does not complete the course and instead of leaving the game that player becomes "poison". From then on, when that player hits another ball, the other ball goes out of play. When all players are eliminated, the final player left on the field is declared the victor. Another common twist to the poison-type croquet game is that if the poison player goes through a wicket or hits a stake, then the poison player is eliminated.

Six wicket croquet is sometimes called American Croquet and is often played between two or more opposing sides or teams. For instance, the blue and black balls may compete against the red and yellow balls. However, players do not have to play in teams, but may engage in cut-throat, everyone-fendfor-themselves-type play as well. In singles play each player may play two balls; in doubles each player plays the same ball throughout the game. Play can effectively commence with anywhere between 2 to 12 balls. The object of the game is to maneuver the balls through a course of six wickets and into the stake, as shown in the standard six wicket play setup 200 depicted FIGS. 2-3. The team or player that gets all of the balls through the course first wins the game. Optionally, players may elect to play a "poison"-type game as described supra in relation to standard nine wicket croquet.

Figure 2:
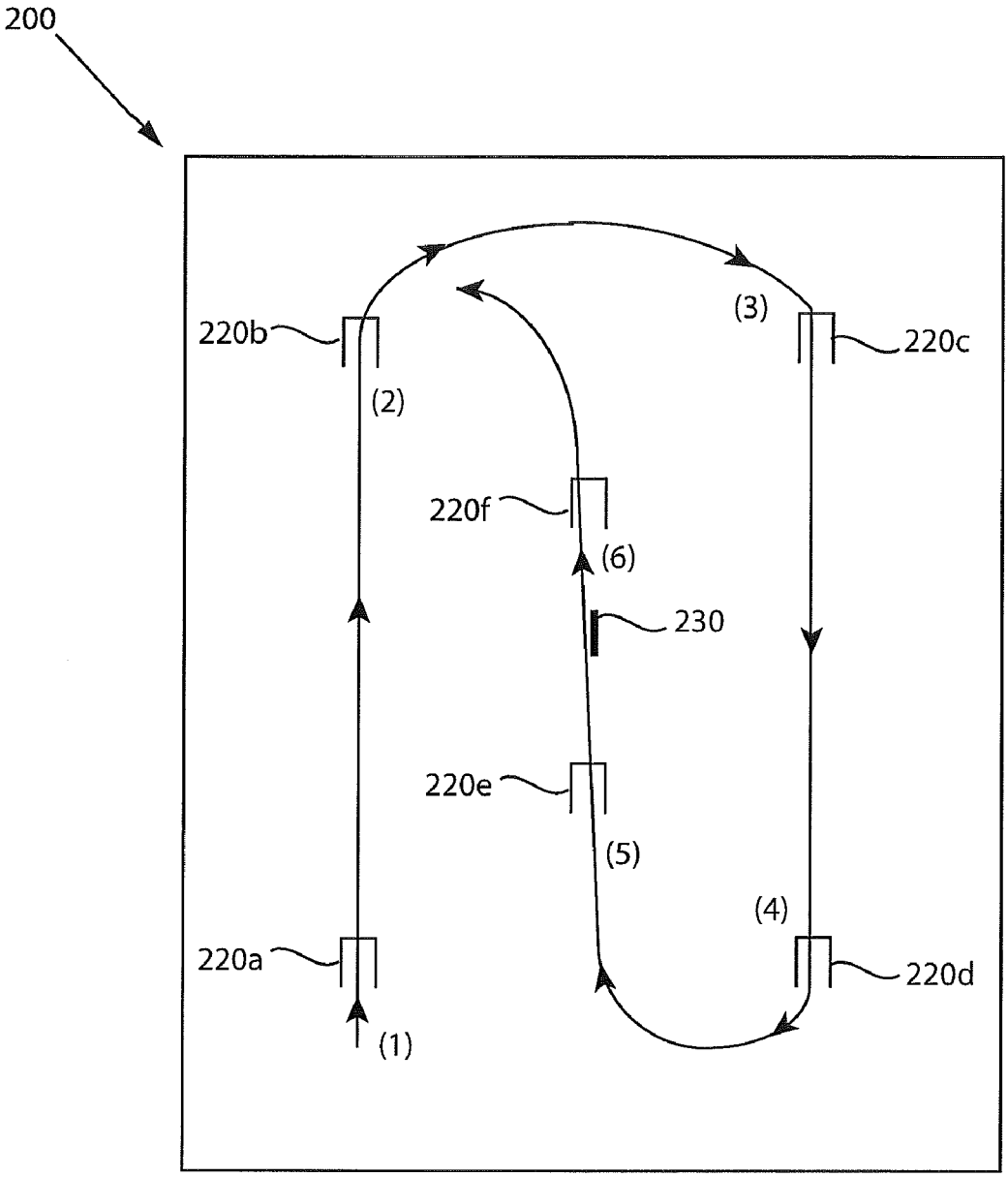
FIG. 2 depicts a top view of a standard six wicket set up with initial forward ball progress, in accordance with the present invention.
Figure 3:
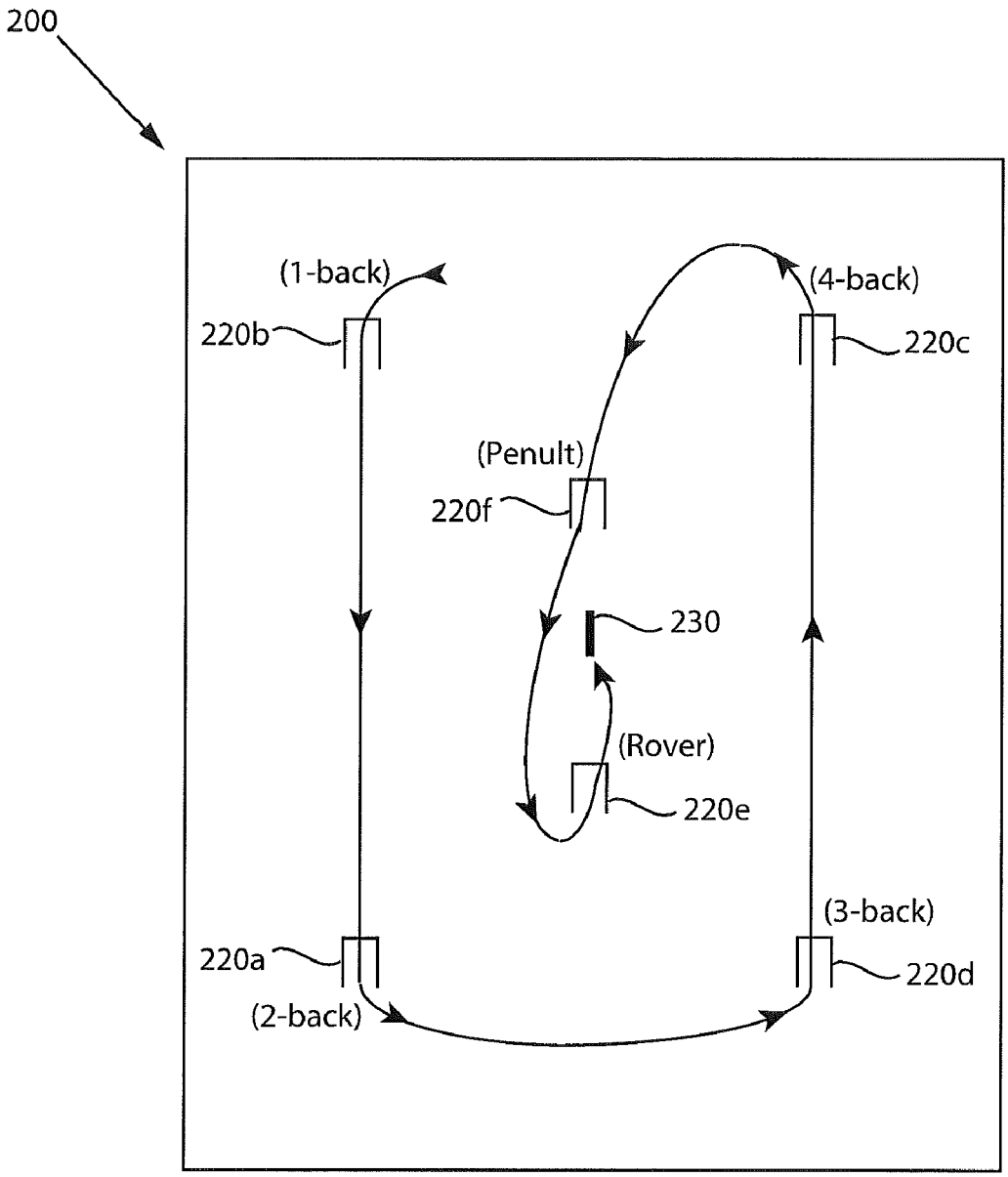
FIG. 3 depicts a top view of a standard six wicket set up with return back ball progress, in accordance with the present invention.

Standard six wicket play typically commences at a position (1), as shown in FIG. 2. the ball is driven through wicket 220*a* to a position (2), and then through wicket 220*b* and around to a position (3). From there the ball is hit through wicket 220*c* and down to a position (4). After moving through wicket 220*d* the ball is curved back up to a position (5) and then passed through wicket 220*e* to a position (6). Following being hit through wicket 220*f* the ball is readied to repeat the process in pseudo-reverse. As depicted in FIG. 3, the ball moves from a position (1-back) through wicket 220*b* down to a position (2-back). Then the ball is maneuvered through wicket 220*a* and curved around to a position (3-back). From there the ball is hit through wicket 220*d* and up to a position (4-back). After moving through wicket 220*c* the ball is curved back down to a position called (penult), which is short for penultimate. Then the ball is passed through wicket 220*f* and down to a position in preparation for (Rover). Once the ball is hit through wicket 220*e* for the second time, the ball is in a Rover condition; hence, the ball can become poison. After hitting the center stake 130, the ball is dead if playing single player cut throat version and the player wins the game. If playing in teams, both players must hit the stake to win the game.

Like nine wicket croquet, play is made by striking a ball with a mallet. The player who is playing a turn is called the striker, and the ball in play for that turn is the striker ball. Similar to nine wicket croquet, in six wicket croquet turns are typically played in the sequence blue, red, black, yellow, and so on up to as many balls are involved in the game. This sequence game play typically corresponds to a depiction of colors usually painted on the stake 230. Each turn is initially one stroke, but extra strokes may be earned when the striker ball hits another ball or scores a wicket point by clearing a wicket. As such, bonus strokes are obtained in a manner similar to the obtaining of bonus strokes in nine wicket croquet. By making good use of extra strokes it is possible to score many points in one turn.

In a rigorous six wicket American Croquet game, the striker must never strike any ball other than the striker ball. In addition, the striker must play using the mallet only, and must not touch the ball with anything but the mallet. The striker must strike the ball with one of the mallet's two striking faces and never with a side face or the shaft. Moreover, the striker must strike the ball cleanly and only once during the stroke. However, six wicket games can be played with less rigorous rules and more player leeway to hit or otherwise strike balls. Often each ball has a corresponding clip, used to show which wicket the ball needs to score or pass through next. As in nine-wicket croquet, if the striker ball hits another ball it is called a roquet, and the striker becomes entitled to play a croquet stroke to "send" away the ball that was hit.

Under rigorous rules, the striker ball cannot both score a point by passing through a wicket and also make a roquet by hitting another ball on the same stroke. Whichever happens first takes precedence. A ball that has passed through all six wickets twice (once in one direction FIG. 2 and then again in the return direction FIG. 3) is called a rover ball. If a rover ball hits the center stake then that ball has scored the stake point and is removed from the game. Play continues in the usual sequence, skipping over the missing ball. The game ends when all balls of a side have scored the stake or been poisoned by a poison rover ball if the game involves poison-type play. A rover ball may roquet another ball only once per turn. The striker ball cannot both score the stake and make a roquet on the same stroke. Whichever happens first takes precedence.

Figure 4:
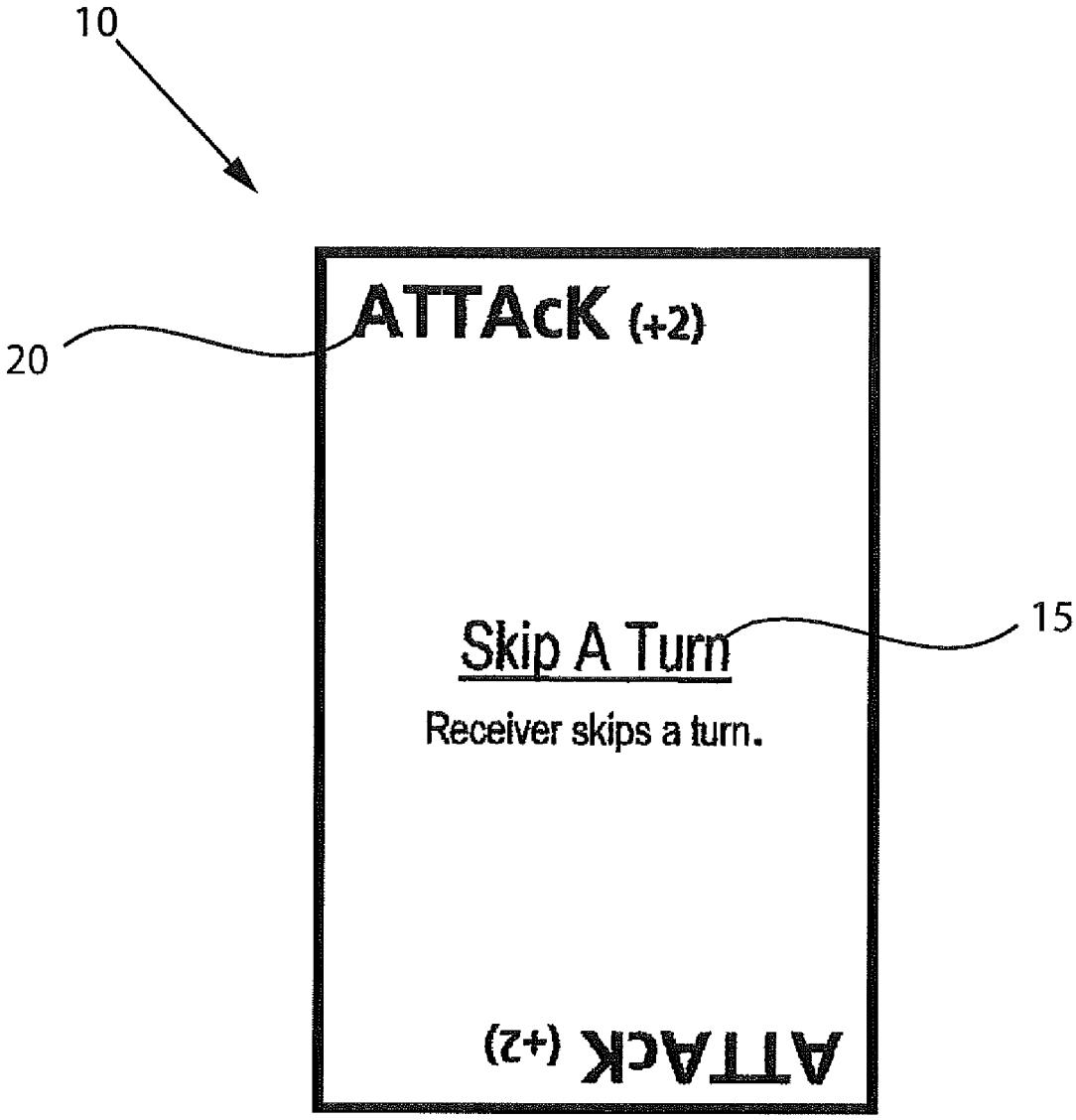
FIG. 4 depicts a top view of an embodiment of a playing card having croquet game modifying instructions, in accordance with the present invention.

The present invention is a new game that brings fresh life and excitement to the standard game of croquet. It is an innovative game that incorporates the beloved past-time of croquet and adds some twists. As depicted in FIG. 4, a croquet modifying card game comprises at least one indicator with player instructions such as playing card 10. The playing card 10 includes player instructions 15, wherein the player instructions 15 modify standard play of a game of croquet, such as by directing a player to skip a turn. The playing card 10 can be existent as an ordinary paper or plastic playing card, a digital representation in a virtual environment, or an electronic display module, such as an LCD screen on a PDA, iPod® or cell phone that is capable of conveying instructions or croquet game modifying action commands. The instructions 15 can be existent as directions printed on an ordinary paper or plastic playing card 10, textual instructions displayed on an LCD screen playing card 10, voice commands broadcast from an iPod®, PDA or cell phone-type playing card 10, or other similar commands that are provided to exist in a repeatable playing card 10 media. In general, the playing cards 10 having instructions 15, may be provided as any means capable of effective conveyance of repeatable game modifying commands during a standard croquet game.

Figure 5:
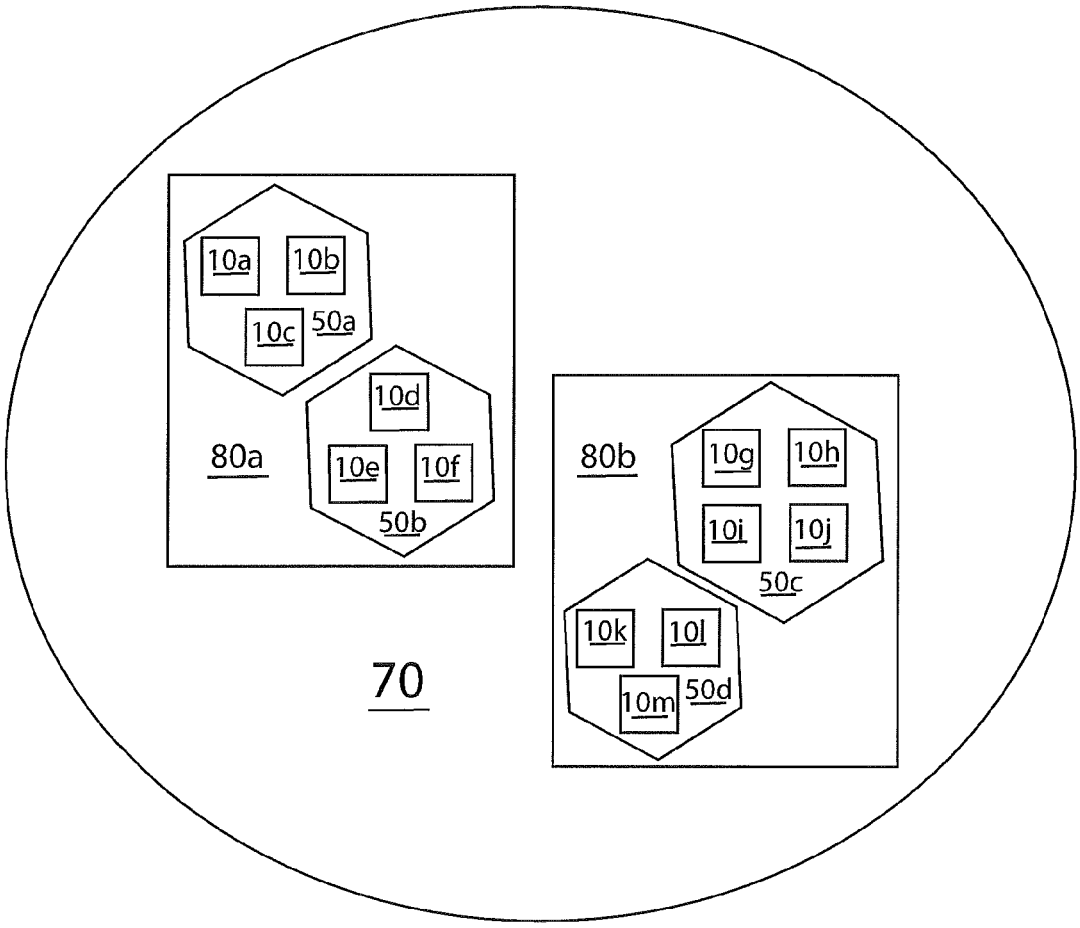
FIG. 5 depicts a schematic view of an embodiment of a playing card existent in an embodiment of a set of playing cards.

A playing card 10 may be included as one card in a plurality of playing cards 10*a-m* existent in a set of playing cards 70, as shown schematically in FIG. 5. Each playing card 10*a-m* in the set 70 of playing cards 70 may include player instructions, such as instructions 15 (see FIG. 4). The player instructions, such as instructions 15, of each card 10*a-f* modify standard play of a game of croquet.

The set 70 of cards, such as cards 10*a-m*, may also include a color-coded deck of cards 80*a*, wherein the color 50*a* or 50*b* of each card 10*a-m* corresponds to a category of croquet play modification. For instance, playing cards, such as cards 10*a-c*, may be colored according to a first color-code color 50*a* and the player instructions, such as instructions 15, of the playing cards 10*a-c* may fall under a category of attack. The attack instructions, as categorically color coded under 50*a*, modify croquet game play by interfering with ball progress, shot accuracy, or altering the course layout. In addition, playing cards, such as cards 10*d-f*, may be colored according to a second color-code color 50*b* and the player instructions, such as instructions 15, of the playing cards 10*d-f* may fall under a category of defense. The defense instructions, as categorically color coded under 50*b*, modify croquet game play by blocking or changing play modifications of an attack, enhance or wild card, by helping the play of another player or team mate or by altering the course layout. Furthermore, playing cards, such as cards 10*g-h*, may be colored according to a third color-code color 50*c* and the player instructions, such as instructions 15, of the playing cards 10*g-h* may fall under a category of enhance. The enhance instructions, as categorically color coded under 50*c*, modify croquet game play by enhancing a player's own play, the play of another player or teammate, hampering the play of another player, or altering the course layout. Additionally, playing cards 10*i-j* may be provided and may also be colored according to the third color-code color 50*c*. However, the player instructions 15 of the playing cards 10*i-j* may fall under a category of impact, wherein impact instructions modify croquet game play by expanding the impact of an attack card, a defense card, or an enhance card, to modify play pertaining to more than one player, or to alter the course layout. Still further, playing cards, such as cards 10*k-m*, may be colored according to a fourth color-code color 50*d* and the player instructions, such as instructions 15, of the playing cards 10*k-m* may fall under a category of wild. The wild instructions, as categorically color coded under 50*d*, modify croquet game play by offering non-standard unique play opportunities to one, a few, or all croquet players.

Figure 6:
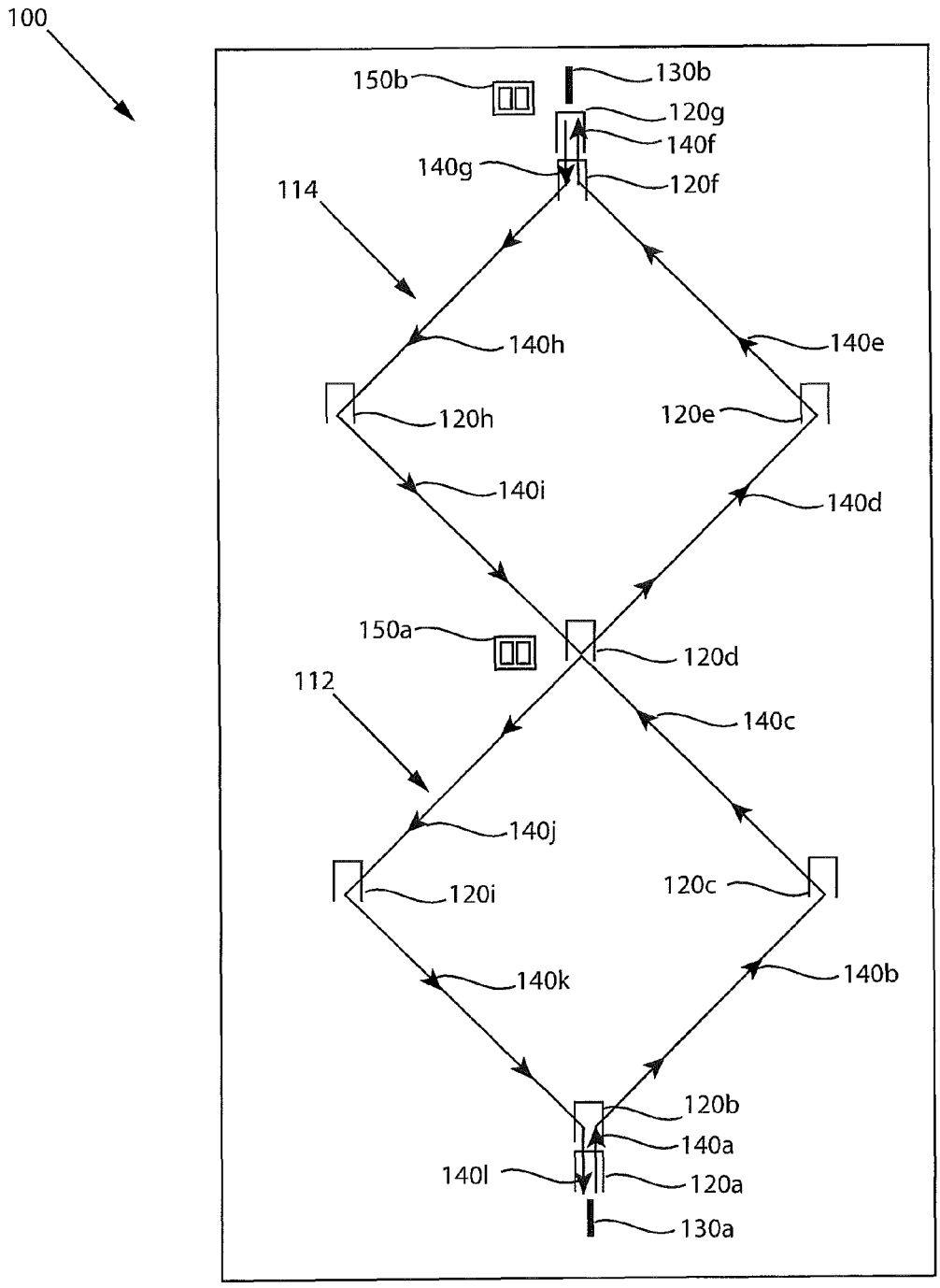
FIG. 6 depicts a top view of a standard nine wicket setup showing playing card draw locations, in accordance with the present invention.

Playing cards 10 may be introduced into a standard croquet game at any time during the game. It is often desirable to introduce playing cards 10 at strategic locations in a standard croquet setup, such as a nine wicket setup 100 shown in FIG. 1, or a six wicket setup 200 shown in FIGS. 2-3. For example, rules may be provided so that some playing cards 10 are distributed to croquet players before play begins. Hence, with cards in hand, a playing card 10 may be played by anyone at anytime on the particular player whose turn it is at the beginning of any shot they are about to take. Players may have many shots during a turn and cards 10 may be played at the beginning of any shot. It also may be desirable to replenish or otherwise introduce additional playing cards 10 during game play. For instance, a croquet setup, such as nine wicket setup 100 or six wicket set up 200, may be provided with locations where additional cards 10 may be drawn by players as the players pass the locations. An exemplary embodiment is depicted in FIG. 6, which shows playing card 10 draw locations 150*a-b* at both the center wicket 120*d* and the turn stake 130*b* of a standard nine wicket setup 100. Other embodiments may introduce cards 10 in different ways at different locations and different times. Cards 10 may be shuffled, randomized, grouped, ordered, or otherwise arranged for particular provision to croquet players. Wild cards may be organized for separate distribution and differing croquet game modification by having the cards immediately affect one, a few, or all players when the cards are drawn. The wild cards may also alter the course layout and effect attack, defense, enhance and impacts cards.

Playing card 10 instructions 15 may modify croquet play in various ways. For example, the instructions 15 may direct physical altering of the course during play, such as by moving wickets or adding obstacles and obstructions. Furthermore, instructions may command peculiar body positions of players before, during, or after shots. For instance, a player may be directed to take a shot while standing on one leg with a patch over his or her eye. In addition, the instructions 15 may work in conjunction with a point system assigned to standard game play in conjunction with card play. Points may be assigned for the order in which players reach the half-way stake or the order in which players finish the game at the final stake. Points may also be added or subtracted based on the cards 10 that are played on and by a particular player. In other words credit may be given to the player for the number of shot hindrances they may have had to endure to finish the game, while points may be subtracted for the number of enhancements they used to help their play. The point values may be shown on the cards 10, such as in the lower left corner as in FIG. 4. If no point's value is shown, the card 10 may carry a neutral value. At the end of the game, as each player finishes, if any cards are left in their hand, those point values indicated on the individual cards 10 may be subtracted from a player's total score. In addition, a player who becomes Poison or Rover can make other players lose points for each time they are hit.

Figure 7:
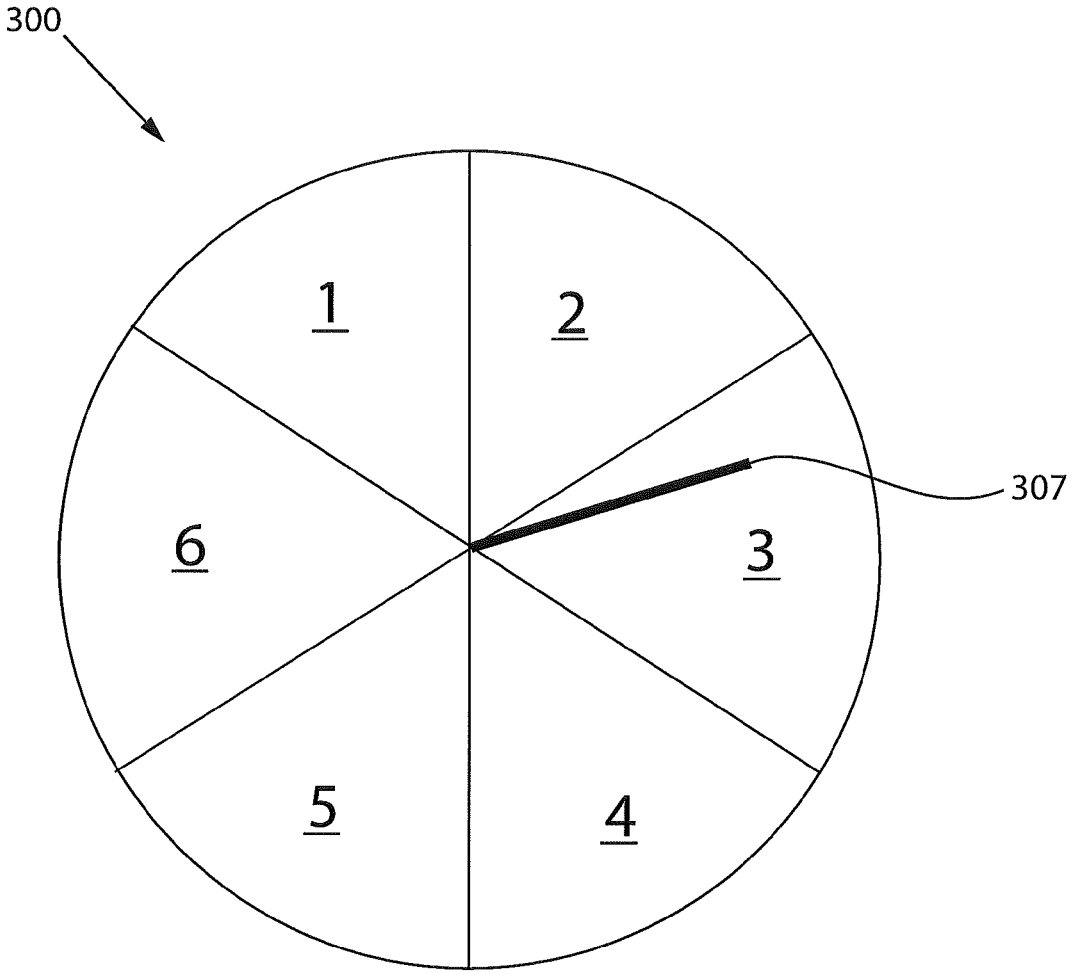
FIG. 7 depicts a top view of an embodiment of a spinning wheel, in accordance with the present invention.

An embodiment of a spinning wheel 300, as shown in FIG. 7, may be provided to further modify croquet game play. The spinning wheel 300 may include two or more separately marked partitions. One to six partitions are shown with a rotatable pointer 307 in FIG. 7 as an example. The six partitions may be numbered 1-6 and also may be color coordinated. Hence, card 10 instructions 15 may direct players to spin the wheel 300 so that the pointer can randomly land on a partition which may correspond to the color ball of a player to be affected by the directing card 10, the number of players to be affected by the card 10, or various other combinations of play modification corresponding to the spinning wheel 300. Additionally, croquet game modification may include provision of implements such as a card tray, a color-coded ball marker, an eye patch to cover a croquet player's eye, a blind fold, a score card, a clip to hold a card such as a playing card or score card, a pencil, an instruction manual providing basic instructions on how to use the card game to modify play of a croquet game, and a rule summary sheet outlining basic rules of six wicket and nine-wicket croquet.

In further view of the drawings, a method of playing croquet is described with respect to FIGS. 1-7. The croquet playing method may include providing a standard croquet setup, such as a nine wicket course setup 100 or a six wicket course set up 200. As described supra, the setup may be present as a traditional lawn croquet course, or may exist within an environment without an actual physical field. Additionally, the method may include providing at least one playing card 10. The playing card 10 includes player instructions 15 that modify standard play of a game of croquet involving at least two participants. The participants may be human players, may be virtual avatars, or may be computer controlled processes functioning according to governing protocol reactive with the player instructions 15. Further methodology may include participants beginning standard play of the croquet game involving common croquet rules and actions. The croquet playing method additionally includes modifying standard play of the croquet game through application of the instructions 15 on the at least one playing card 10. Still further croquet playing methodology may include alterations of the standard croquet setup during play of the game, directives commanding a peculiar body position of a participant during a shot, and/or player instructions directing the spinning of a spinning wheel, such as spinning wheel 300.

While this invention has been described in conjunction with the specific embodiments outlined above, it is evident that many alternatives, modifications and variations will be apparent to those skilled in the art. For example, an indicator may be a card; set of cards; spinner; electronic output such, as a PDA or computer; or any other device capable of producing a randomly generated set. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A method of modifying croquet play comprising:

providing a croquet setup, the croquet setup including at least two wickets;

providing at least one indicator, the at least one indicator including player instructions beyond those of standard croquet rules, wherein the player instructions, when applied, modify play of a game of croquet involving at least two participants during play of the croquet game by including at least one game modifying command selected from the group consisting of: a directive altering the croquet playing area environment, a directive altering croquet course arrangement, a directive altering standard croquet rules, a directive altering conduct of a player's own croquet playing actions, and a directive altering player-to-player interaction during the croquet game;

beginning play of the croquet game; and modifying play of the croquet game, after play has started and during game play, through application of the game modifying command instructions provided by the at least one indicator.

2. The method of modifying croquet play of claim 1, wherein the modification alters the croquet playing area environment by adding obstructions to a player's shot during game play.

3. The method of modifying croquet play of claim 1, wherein the modification alters the conduct of a player's own croquet playing actions by directing peculiar body position of a participant during a shot.

4. The method of modifying croquet play of claim 1, wherein the modification includes application of player instructions directing the altering of a croquet course arrangement, by moving wickets during game play.

5. The method of modifying croquet play of claim 1, wherein the modification includes the incorporation of a point system associated with the at least one indicator.

6. The method of modifying croquet play of claim 1, wherein the indicator is at least one playing card including printed player instructions.

7. The method of modifying croquet play of claim 6, further comprising multiple indicators, the multiple indicators being multiple playing cards forming a set of cards, wherein the set of cards comprises categorized cards, wherein each card is marked with a category that corresponds to a category of croquet play modification.

8. The method of modifying croquet play of claim 7, further comprising multiple decks of cards, wherein each deck corresponds to a difficulty level pertaining to croquet game modification.

9. The method of modifying croquet play of claim 3, wherein the modification alters conduct of a player's own actions, by directing the player to take a shot while standing on one leg and wearing an eye patch.

10. The method of modifying croquet play of claim 1, wherein the modification alters player-to-player interaction, by permitting one player to force another player to skip a turn.

11. The method of modifying croquet play of claim 1, wherein the indicator is positionable by a croquet participant at various locations within a play area environment associated with croquet play.

12. The method of modifying croquet play of claim 1, wherein the croquet setup further includes:

at least one stake positioned apart from the at least two wickets;

a plurality of balls operable to interact with the at least two wickets and the at least one stake; and a plurality of mallets configured to move any of the plurality of balls into operable interaction with any of the at least two wickets, the at least one stake, and any other of the plurality of balls within a play area environment.

* * * * *